367-93 $$$ SR
E245K OR 3,980,998

United
McIntosh T283 7C

[11] 3,980,998
[45] Sept. 14, 1976

[54] INTRUSION ALARMS

[75] Inventor: Lawrie G. McIntosh, Etobicoke, Canada

[73] Assignee: Contronic Controls Limited, Mississauga, Canada

[22] Filed: Sept. 5, 1975

[21] Appl. No.: 610,906

[52] U.S. Cl. ..... 340/258 B; 340/258 A; 340/276; 312/252

[51] Int. Cl.[2] ..... G08B 13/18

[58] Field of Search ..... 340/258 A, 258 B, 276; 312/210, 213, 257 R, 252

[56] References Cited

UNITED STATES PATENTS

| | | | |
|---|---|---|---|
| 3,512,155 | 5/1970 | Bloice | 340/258 A |
| 3,691,556 | 9/1972 | Bloice | 340/258 A |
| [illegible] | 75 | Cheal et al. | 340/258 A |

OTHER PUBLICATIONS

*Mountain West Alarm Supply Co. Cat.*, Phoenix, Ariz., 1974, Inside of Cover, pp. 9, 11, 19.

*Primary Examiner*—Glen R. Swann III
*Attorney, Agent, or Firm*—Rogers, Bereskin & Parr

[57] ABSTRACT

An ultrasonic intrusion alarm is described. In the specific embodiment described with reference to the drawings, the alarm includes a transmitter and a receiver both mounted in a cylindrical housing. The housing is turnably held in contact with a base by a grill cloth. In use the housing is turned to direct the transmitter. The grill cloth prevents the area protected by the alarm being visually determined from externally of the alarm.

6 Claims, 4 Drawing Figures

INTRUSION ALARMS

This invention relates generally to intrusion alarms of the kind which are operated by radiation (e.g. ultrasonic radiation) and which include at least one radiation transducer. In particular, the invention is concerned with an intrusion alarm transducer mounting.

In the case of an ultrasonic alarm for example, the alarm may include a first transducer for transmitting ultrasonic radiation and a second transducer for receiving reflected radiation emanating from the first transducer. The alarm is adapted to detect and respond to changes in said reflected radiation. Other types of alarm (e.g. infra-red alarms) may include a single transducer and may operate by detecting radiation emanating from remote sources.

Conventional alarms of the general kind referred to include housings or casings which are often relatively unsightly and obtrusive when installed. Apart from aesthetic considerations, an alarm of this type is readily recognizable as an alarm. An intruder will therefore usually be aware of the existence of the alarm and may be able to take steps to avoid triggering the alarm or to render it inoperative.

Some conventional alarms cannot be adjusted to vary the direction in which the alarm is directed and hence the area protected by the alarm. U.S. Pat. No. 3,512,155 discloses an example of an alarm of this type. Other types are adjustable. However, in many cases, the area protected is readily apparent from a visual inspection of the alarm, even from some distance away. U.S. Pat. No. 3,806,941 discloses an alarm of this type.

An object of the present invention is to provide an improved intrusion alarm transducer mounting.

According to the invention, the mounting includes a base, and a hollow cylindrical housing having a longitudinal axis and arranged in contact with the base for turning movement about said axis. A directional radiation transducer means is located in the housing and is positioned so that the housing can be turned about said axis to direct the transducer means. The housing of the alarm is concealed from view and is turnably retained in contact with the base by sheet-form screening means having opposite longitudinal margins coupled to the base and extending around the housing. The screening means is at least substantially transparent to said radiation.

The invention will be better understood by reference to the accompanying drawings, which illustrate one embodiment of the invention by way of example, and in which.

Figure 1:
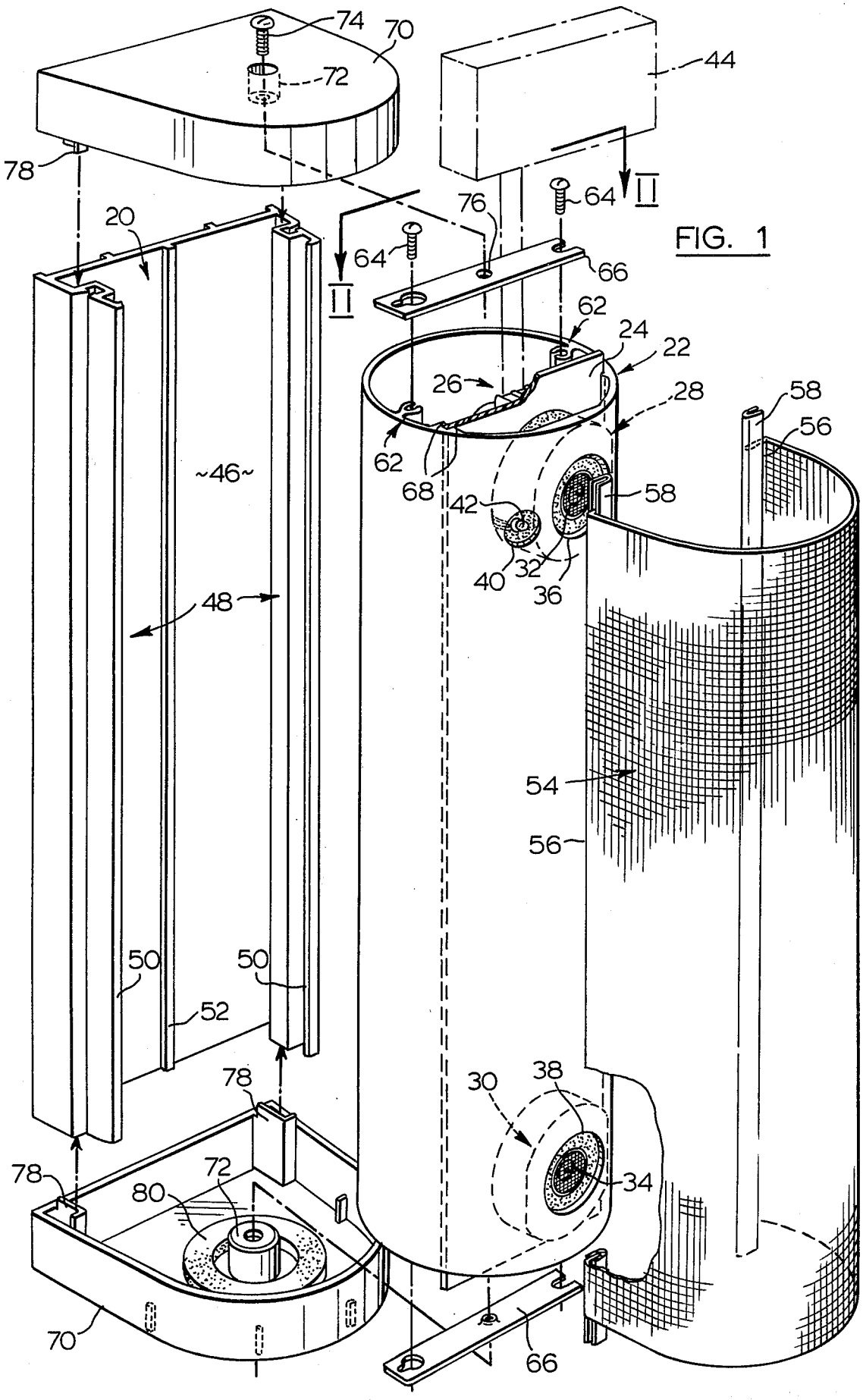
FIG. 1 is an exploded perspective view of an intrusion alarm having a transducer mounting according to the invention.

Referring first to FIG. 1, the transducer mounting of the alarm includes a base generally denoted 20 and a hollow cylindrical housing 22 which is turnably supported on the base in the assembled condition of the alarm. Located in the housing 22 is a baseboard 24 for the circuit connections and components of the alarm.

In this embodiment, the alarm is of the ultrasonic type. Since this type of alarm is well known, its circuit and components will not be described in detail. For present purposes, it is sufficient to note that printed circuits are provided on both sides of the baseboard 24. The majority of the electrical components are mounted on the side of the baseboard 24 which is at the rear in FIG. 1. Parts of a number of these components are visible at 26. The opposite face of the baseboard carries a first transducer in the form of an ultrasonic transmitter 28 and a second transducer in the form of an ultrasonic receiver 30. Both of these components are entirely conventional. The cones of the transmitter and receiver are visible at 32 and 34 respectively. Housing 22 is formed with circular apertures 36, 38 at the positions of the transmitter and receiver respectively to allow passage of radiation through the wall of the housing. A smaller circular opening 40 is located adjacent opening 36 and a light emitting diode 42 is arranged inwardly of the opening and is coupled to the circuit of the alarm. Diode 42 acts as a test indicator and is illuminated when the alarm is activated during a test. The diode is rendered inoperative when the alarm is in normal use. In an alternative embodiment an audible test indicator may be used.

The circuit is coupled to a signalling device 44 such as a light or bell which is activated when the alarm is triggered. In this embodiment, the signalling device 44 is located remote from the alarm unit itself although the device could of course be built into the unit.

As is well known, an ultrasonic alarm of this type operates as follows. Ultrasonic radiation is transmitted by the transmitter 28 and is reflected back to the receiver 30. The transmitter and receiver are oriented as will be described so that the radiation is transmitted towards and reflected from the area to be protected by the alarm. For example, in a household room, the alarm would probably be arranged so that the radiation is transmitted towards a door of the room. In any event, changes in the radiation received by the receiver cause the alarm circuit to be triggered to operate the signalling device 44.

The base 20 of the alarm is a plastic extrusion which includes an elongate, generally rectangular bottom portion 46 and longitudinal side walls 48. The cross-sectional shape of the base 20 can best be seen in FIG. 2. The side walls 48 each define an inwardly directed rib 50, having an inner edge which bears against the curved surface of the cylindrical housing 22. A similar rib 52 extends along the longitudinal median line of the bottom portion 46 of the base and also has an inner edge which bears against the curved surface of the cylindrical housing 22. Accordingly, the ribs 50 and 52 in effect define bearing surfaces permitting the housing to turn with respect to the base.

The housing 22 is held in contact with the base 20 by a grill cloth 54 which is of rectangular shape and which has opposite longitudinal margins coupled to the base. As can be seen from FIG. 1, the grill cloth 54 is of generally rectangular shape and is transversely curved in the assembled condition of the alarm (see also FIG. 4) to conform generally with the shape of the housing 22. The grill cloth 54 is made of a woven material of the type conventionally used, for example, for loudspeakers.

The material is transparent to ultrasonic radiation and appears substantially opaque when viewed at a distance. In this embodiment the material is type N1301-1 manufactured by Wendell Fabrics Corporation of North Carolina U.S.A. It is made of crimped plastic filaments and exhibits the properties of minimum "creep" and slight stretchability. The code N1301-1 denotes a black fabric; the code varies for different colours. It is of course to be understood that equivalent fabrics may be available from other sources. In any event, the grill cloth defines opposite longitudinal margins 56, each of which is gripped by a U-section metal strip 58.

Figure 2:
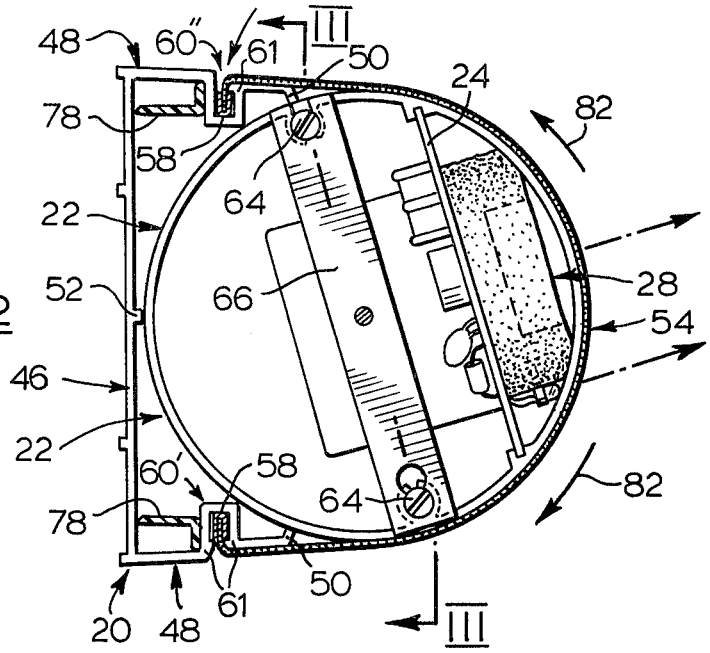
FIG. 2 is a transverse cross-sectional view on line II—II of FIG. 1.

As can be seen more particularly from FIG. 2, each side wall 48 of the base 20 is formed with an outwardly facing channel which extends longitudinally of the side wall parallel to the bottom portion 46 of the base. The channel which is at the bottom in FIG. 2 is denoted 60' and the other channel is denoted 60''. Both side walls of channel 60' are formed with triangular-section protrusions 61 which project inwardly of the channel to constrict its mouth. A similar protrusion 61 extends along one side wall only of channel 60''. The normal method of fitting the grill cloth is to first slide the relevant one of the strips 58 into channel 60' from one end of the base so that the grill cloth passes between the protrusions 61. The grill cloth is then drawn around the housing 22 and the other strip 58 is push fitted into the channel 60'' past its single protrusion 61 in the direction of the arrow in FIG. 2. The grill cloth is dimensioned and the strips 58 are arranged so that the cloth is relatively lightly tensioned in its fitted condition. This allows the housing 22 to be turned relatively easily with respect to the base but prevents the housing moving out of contact with the ribs 50, 52 of the base to any appreciable extent.

Housing 22 itself is manufactured by metal extrusion generally in the form of a cylinder. Two C-shaped formations 62 extend longitudinally of the inside surface of said cylinder on a common diametral plane. The outer end portions of each formation 62 are internally screw threaded to receive screws 64 (visible adjacent the upper end of the cylinder in FIG. 1). These screws are used to secure a diametral plate 66 across the end of the cylinder. A similar plate 66 is fixed to the lower end of the cylinder by similar screws (not shown). The inside surface of the cylinder is also formed with two pairs of inwardly directed ribs 68 between each pair of which the baseboard 24 is located. The ribs 68 are positioned so that the baseboard is located in a chordal plane parallel to the plane containing the formations 62. The baseboard 24, carrying the electrical components 26 and the transmitter 28 and receiver 30 can accordingly be slid into and out of the housing in the axial direction thereof.

A pair of end caps 70 are coupled to the base 20. The caps are profiled to conform generally with the profile of the cylinder and base combination as shown in FIG. 2. Each end cap is formed with an inwardly directed boss 72 which bears against the relevant one of the plates 66 in the assembled condition of the alarm. The end caps are secured in place by screws 74 (only one of which is visible in FIG. 1). Each screw passes through a central aperture in the relevant boss 72 and is received in a screw-threaded hole 76 in the relevant plate 66. In addition, each end cap is formed with two inwardly directed angled projections 78 (visible in cross-section in FIG. 2) which locate between the bottom portion 46 of the base and the portions of the walls 48 defining said outwardly facing channels 60', 60''.

Figure 3:
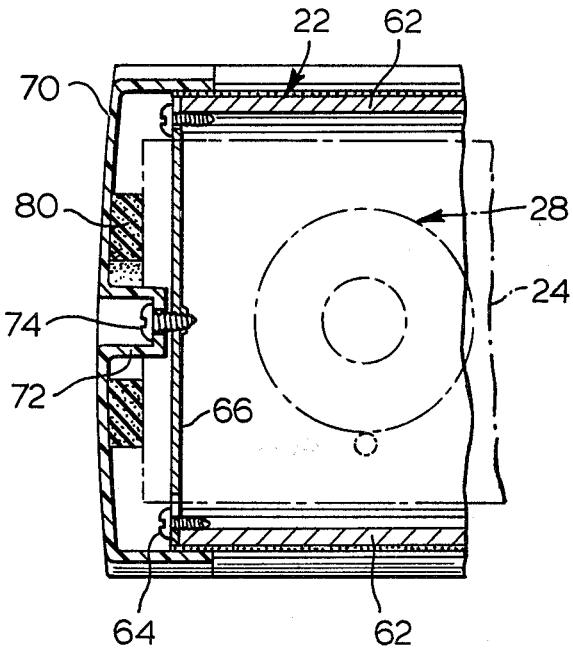
FIG. 3 is a partial longitudinal sectional view on line III—III of FIG. 2; and, FIG. 4 is a perspective view of the alarm of the previous figures in the assembled condition.

Each of the end caps 70 is provided on its inner face with an annular cushioning member 80 which is concentric with the boss 72. As can be seen from FIG. 3, the cushioning members 80 and the two end caps 70 serve to restrain the baseboard 24 (indicated in chain lines) against longitudinal movement in use.

Figure 4:
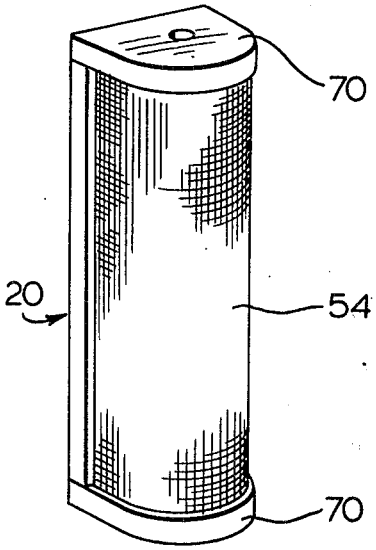

FIG. 4 shows the assembled alarm in a typical position in which it would be installed in use. The alarm may be screwed to a wall or other vertical surface in this arrangement. The particular orientation of the alarm will depend on the situation in which it is being used. In some cases, it may be more convenient to arrange the alarm horizontally.

In any event, once the position of installation has been determined, the transmitter and receiver are directed to face towards the area to be protected. This is done by removing one of the end caps 70 and turning the cylindrical housing 62 with respect to the base as indicated by the arrows 82 and FIG. 2. When the final angular position of the housing has been determined, the end cap is replaced. Since the grill cloth 64 is opaque when viewed from a distance, an intruder is unable to determine the direction in which the alarm is aimed. Further, the unobtrusive appearance of the alarm, particularly when fitted in a furnished room, makes the unit difficult to recognize as an alarm. Even if an intruder does recognize the alarm, the grill cloth prevents him determining in which direction the alarm has been aimed.

It should of course be noted that the preceding description relates to a specific embodiment of the invention only and that many modifications are possible within the broad scope of the invention. For example, the alarm need not be an ultrasonic alarm. Infra-red and microwave alarms are examples of other types of alarm which may be constructed according to the invention. Of course, the circuitry and the form of the transducer(s) will vary depending on its type. In the case of a microwave alarm, a single transducer unit for both transmitting and receiving microwave radiation may be used. A passive infra-red alarm on the other hand does not transmit radiation. This type of alarm includes a single transducer in the form of a detector responsive to temperature changes. Where the alarm includes more than one transducer, each one may have a separate mounting according to the invention. For example, an alarm may include a single transducer for transmitting radiation and a series of "satellite" receiving transducers each transducer having its own mounting.

The housing for the radiation transducer may be apertured to permit passage of radiation therethrough, for example, as described above. However, with some types of alarm, the housing need not be apertured if it is made of a material which is transparent to the radiation. In this event, it may be necessary to mark the housing to indicate the direction in which the alarm is aimed. The marking would be used during installation or adjustment of the alarm and would be concealed by the screening means in normal use.

In the embodiment described with reference to the drawings, the alarm is a self contained unit including means for signalling an alarm condition. In an alternative embodiment, these means could be located remote from the alarm housing.

The method of mounting the radiation sensing means and, where appropriate the alarm circuitry inside the cylindrical housing may also vary. The slot-in baseboard arrangement described above is not essential.

Finally, it is to be understood that the grill cloth 64 described above may be replaced by any appropriate sheet-form screening means, for example, an expanded metal grill or screen.

In the case of a microwave transducer, the screening means may for example, be of the same material and construction as that described above with reference to the drawings. Where the transducer is an infra-red transducer, the screening means may, for example, be made of woven polyethelene filaments.

I claim:

1. An intrusion alarm transducer mounting comprising:

a base;

a hollow cylindrical housing having a longitudinal axis and arranged in contact with said base for turning movement about said axis;

directional radiation transducer means located in said housing and positioned so that the housing can be turned about said axis to direct the transducer means; and sheet-form screening means having opposite longitudinal margins coupled to said base and extending around said housing so as to conceal the housing from view whilst turnably retaining the same in contact with the base, said screening means being at least substantially transparent to said radiation.

2. A transducer mounting as claimed in claim 1, further comprising a baseboard located in said cylindrical housing for sliding movement in the axial direction of the housing when the baseboard is to be withdrawn from the housing, the radiation transducer means being mounted on one side of the baseboard and the baseboard also carrying components of an alarm circuit for said transducer means.

3. A transducer mounting as claimed in claim 1, wherein said base includes a bottom portion and longitudinally extending side walls, said bottom portion and side walls defining longitudinal ribs on which the cylindrical housing is turnably supported.

4. A transducer mounting as claimed in claim 3, wherein each of said side walls is formed with a longitudinally extending and outwardly facing channel, and wherein the screening means comprises a grill cloth, the respective longitudinal margins of which are fitted with metal edge strips retained in the respective channels.

5. A transducer mounting as claimed in claim 2, further comprising end caps fitted to said base, said end caps being profiled to conform with the profile of the base and housing combination, and cusioning members fitted to the inner faces of said end caps for contact with respectively opposite ends of the baseboard, whereby the baseboard is restrained against longitudinal movement by said cushioning members.

6. An ultrasonic intrusion alarm comprising:

a. a transducer mounting which includes:

a base having a bottom portion and two longitudinally extending side walls, each side wall defining a longitudinal rib and being formed with an outwardly facing channel;

a hollow cylindrical housing having a longitudinal axis and arranged in contact with said ribs of the base for turning movement about said axis;

first transducer means in the form of an ultrasonic radiation transmitter located in said housing;

second transducer means in the form of an ultrasonic radiation receiver also located in said housing and positioned to receive reflected radiation emanating from the transmitter;

the housing being apertured at the positions of said transmitter and receiver to allow passage of radiation from and to said transmitter and receiver respectively;

screening means comprising a grill cloth which is substantially opaque to visible light and at least substantially transparent to said radiation, the grill cloth having opposite longitudinal margins fitted with metal edge strips retained in said channels in the side walls of the base so that the grill cloth is coupled to the base and extends around said housing in a tensioned condition, whereby the housing is turnably retained in contact with the base, and can be turned about said longitudinal axis to vary the direction in which the radiation is transmitted in use, the grill cloth screening said apertures in the housing from view so that the direction of radiation transmission cannot be visually determined from externally of the alarm; and b. means coupled to the receiver for signalling an alarm condition in response to changes in said reflected radiation.

* * * * *